US005580281A

United States Patent [19]

Takeuchi

[11] Patent Number: 5,580,281

[45] Date of Patent: Dec. 3, 1996

[54] CONNECTING STRUCTURE FOR SCREW-DOWN TYPE CONNECTOR

[75] Inventor: Kunihiko Takeuchi, Kosai, Japan

[73] Assignee: Yazaki Corporation, Tokyo, Japan

[21] Appl. No.: 593,127

[22] Filed: Feb. 1, 1996

[30] Foreign Application Priority Data

Feb. 7, 1995 [JP] Japan ..... 7-019435

[51] Int. Cl.[6] ..... H01R 13/68

[52] U.S. Cl. ..... 439/621; 337/210

[58] Field of Search ..... 439/621, 622; 337/186, 201, 208, 210

[56] References Cited

U.S. PATENT DOCUMENTS

| | | | |
|---|---|---|---|
| 4,887,978 | 12/1989 | Murakami | 439/553 |
| 5,314,354 | 5/1994 | Nomura et al. | 439/621 |
| 5,345,211 | 9/1994 | Muramatsu et al. | 439/621 |

FOREIGN PATENT DOCUMENTS 4-54417 5/1992 Japan .

*Primary Examiner*—Gary F. Paumen
*Assistant Examiner*—T. C. Patel
*Attorney, Agent, or Firm*—Oblon, Spivak, McClelland, Maier & Neustadt, P.C.

[57] ABSTRACT

A connecting structure consists of an electrical connection box and a fusible link connector to be inserted into the connection box. The fusible link connector includes an insulating housing, a fusible link and a pair of nuts to be inserted into the housing and fitted at respective predetermined utmost positions therein. The electrical connection box is provided with a concave connector receiving portion into which the fusible link connector is to be inserted and which includes a pair of nut-abutting parts. In process of inserting the connector into the electrical connection box, if the nut-abutting parts come into contact with the nuts in the utmost positions, the parts serve to define the positional limit in inserting the insulating housing to a predetermined regular position. On the contrary, if the nut-abutting parts come into contact with the nuts inserted incompletely, the parts serve to prevent the insulating housing from being inserted into the predetermined regular position.

9 Claims, 3 Drawing Sheets

CONNECTING STRUCTURE FOR SCREW-DOWN TYPE CONNECTOR

BACKGROUND OF THE INVENTION

1. Technical Field

The present invention relates to a connecting structure for connecting a screw-down type connector to an electrical connection box or the like.

2. Description of the Related Art

Generally speaking, when it is required to either connect the electrical connection box to a battery power source or connect a connector for large current to another connector for large current, the above screw-down type connector in which a connector terminal is connected to another terminal through the intermediary of a terminal connection bolt, has been used in order to realize a certain electrical connecting condition therebetween.

As a typical conventional connecting structure for inserting and fitting such screw-down type connector into the electrical connection box, there is known a structure which is composed of a fusible link connector as the screw-down type connector and an electrical connection box into which the fusible link connector is to be inserted.

In the above connecting structure, the fusible link (FL) connector consists of a fusible link, an insulating housing for accommodating the fusible link and a pair of nuts to be inserted into nut-fitting portions provided in the insulating housing.

On the other hand, the electrical connection box is provided with a connector receiving portion into which the FL connector is inserted and fixed thereto. The connector receiving portion consists of an inlet shaped so as to accord with a profile of the insulating housing, an inside wall extending from the inlet downwardly, a plurality of guide grooves formed in the inside wall up and down, a pair of flexible engagement pawls projecting inwardly at the inlet, a housing-abutting part projecting from the inside wall and an opening which opens below the FL connector for radiating heat generated therefrom.

The insulating housing further includes one insert guide formed on a side wall where the nut-fitting portion is not provided and two insert guides formed on the opposite side wall where the nut-fitting portion is not also provided.

In assembly, these guides of the insulating housing are inserted into the guide grooves of the connector receiving portion so as to slide therein while the engagement pawls are engaged with engagement projections formed on the insulating housing. Then, abutting on a lower end of an intermediate wall of the insulating connector, the housing-abutting part serves to restrict a limit of the inserted insulating housing to a predetermined regular position. The housing-abutting part is formed along the lower end of the intermediate wall so as not to close the opening for heat-radiation.

In order to fit the FL connector in the connector receiving portion of the electrical connection box, the lower end of the insulating housing is inserted into the inlet while aligning the guides of the housing with the guide grooves, respectively. With the above insertion of the insulating housing, it can be shifted along the guide grooves downwardly. At the same time when the intermediate wall of the insulating housing comes into contact with the housing-abutting part, the engagement projections engage with the engagement pawls, so that the FL connector can be fitted into the electrical connection box. Under such a condition, an upper end of the insulating housing is positioned in level with an upper surface of the electrical connection box.

In the above-mentioned conventional connecting structure, however, there exists a possibility that even if at least one of the nuts is not inserted up to the predetermined utmost position in the insulating housing, the FL connector can be fitted to the regular position in the connector receiving portion as similar to a case that the nuts are inserted up to the utmost positions. Such an incomplete fitting of the nut would be detected by an operator at the opportunity of tightening a terminal connection bolt to the nut in process of connecting plate terminals of wire harness to fuse terminals of the FL connector. In this case, upon removing the FL connector from the connector receiving portion, the operator has to insert the nut completely, so that the operation will be complicated. Particularly, in case that the nuts are press-fitted in the FL connector, the operator has to fit the nuts again by using a fitting tool. Therefore, such an operation may cause a reduction of the workability in connecting the plate terminals.

SUMMARY OF THE INVENTION

It is therefore an object of the present invention to provide a connecting structure for a screw-down type connector, by which it is possible for the operator to detect the presence of one or more nuts inserted into the insulating housing of the screw-down type connector incompletely, when it is inserted and fitted into the connector connection portion of the electrical connection box.

The object of the present invention described above can be accomplished by a connecting structure comprising:

at least one nut which is formed so as to engage with a terminal connection bolt;

a screw-down type connector including an insulating housing into which the nut is to be inserted and fitted in a predetermined utmost position; and an electrical connection box having a concave connector receiving portion into which the screw-down type connector is to be inserted and fitted in a direction opposite to another direction along which the nut is inserted into the insulating housing, the connector receiving portion being provided with a nut-abutting part for urging the nut;

wherein, when the nut-abutting part comes into contact with the nut in the utmost position, the nut-abutting part serves to define a positional limit of the insulating housing inserted into the connector receiving portion to a predetermined regular position;

wherein, when the nut-abutting part comes into contact with the nut which is not inserted up to the utmost position completely, the nut-abutting part serves to prevent the insulating housing from being inserted into the predetermined regular position.

With the arrangement mentioned above, providing that the nut is inserted up to the utmost positions, the nut would be brought into contact with the nut-abutting part when inserting the screw-down type connector into the connector receiving portion. Thus, in such a case, the positional limit of the inserted insulating housing would be defined to the regular position.

On the contrary, if the nut is inserted into the insulating housing incompletely and when the screw-down type connector is inserted into the connector receiving portion, the nut would be come into contact with the nut-abutting part thereby to prevent the insulating housing from being inserted into the regular position. Therefore, in such a case, it is possible for the operator to detect the presence of the nut inserted incompletely.

In the present invention, preferably, the nut-abutting part is adapted in such a manner that, when the nut is inserted into the insulating housing incompletely, the nut-abutting part allows the nut to move up to the utmost position with the insertion of the screw-down type connector for the predetermined regular position.

In this case, by an operation for inserting the insulating housing into the regular position, it is possible to shift the nut up to the utmost position.

More preferably, the nut is provided with a flange while the insulating housing is provided with a fitting groove into which the flange is to be inserted and when the nut-abutting part comes into contact with the flange, the nut-abutting part serves to prevent the nut from being rotated in tightening the terminal connection bolt to the screw-down type connector.

In the above-mentioned invention, abutting on the flange of the nut, the nut-abutting part serves to prevent the nut from being rotated in tightening the terminal connection bolt. Consequently, the whirl-stop function of the connecting structure for the nut would be developed.

According to the present invention, there is also provided a connecting structure comprising:

a pair of nuts which are formed so as to engage with terminal connection bolts;

a screw-down type connector including an insulating housing into which the nuts are to be inserted and fitted in a predetermined utmost positions; and an electrical connection box having a concave connector receiving portion into which the screw-down type connector is to be inserted and fitted in a direction opposite to another direction along which the nuts are inserted into the insulating housing, the connector receiving portion being provided with a pair of nut-abutting parts for urging the nuts, respectively;

wherein, when the nut-abutting parts come into contact with the nuts in the respective utmost positions, the nut-abutting parts serve to define a positional limit of the insulating housing inserted into the connector receiving portion to a predetermined regular position;

wherein, when at least either of the nut-abutting parts comes into contact with either of the nuts, which is not inserted up to the utmost position completely, the nut-abutting part serves to prevent the insulating housing from being inserted into the predetermined regular position.

In the present invention, preferably, the insulating housing is provided with an intermediate wall having inside and outside surfaces along which the nuts are inserted into the insulating housing, respectively. Further, it is also preferable that the connector receiving portion comprises an opening which opens below the screw-down type connector inserted and a housing-abutting part arranged along a lower end of the intermediate wall of the insulating housing inserted up to the predetermined regular position thereby to abut on the intermediate wall. In addition, it is preferable that the nut-abutting parts are formed to project from the housing-abutting part on both sides of the intermediate wall along the inserting direction of the nuts thereby forming a substantial Y-shaped cross section together with the housing-abutting part.

In such cases, there is no possibility that the opening is closed by either the housing-abutting part or the nut-abutting part. Therefore, the heat-radiation of the screw-down type connector would be carried out through the opening effectively.

Further, since the lower end of the intermediate wall of the insulating housing is supported by the housing-abutting part directly while a lower portion of the intermediate wall is supported by the nut-abutting parts laterally, the screw-down type connector can be attached to the electrical connection box more stably.

DESCRIPTION OF THE PREFERRED EMBODIMENT

An embodiment of the present invention will be described with reference to FIGS. 1 to 4.

Figure 1:
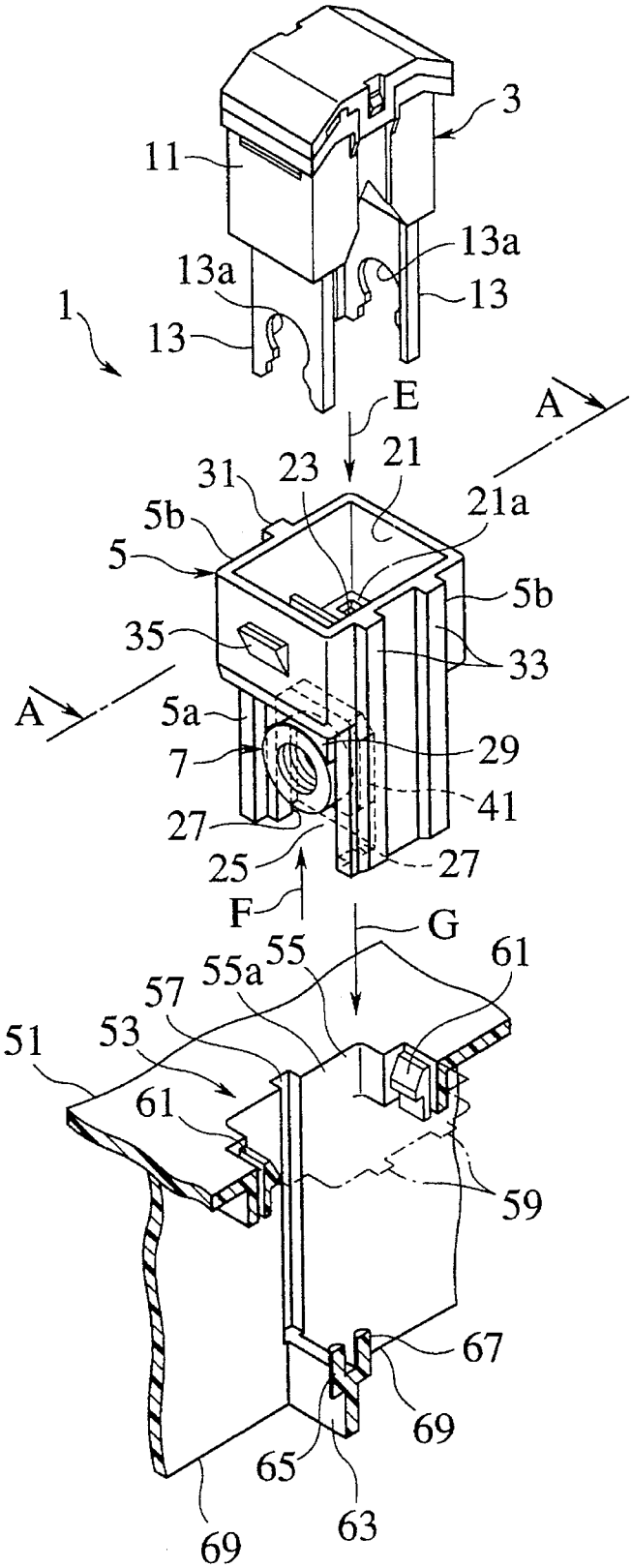
FIG. 1 is a perspective view showing a connecting structure for a screw-down type connector in accordance with an embodiment of the present invention.
Figure 2:
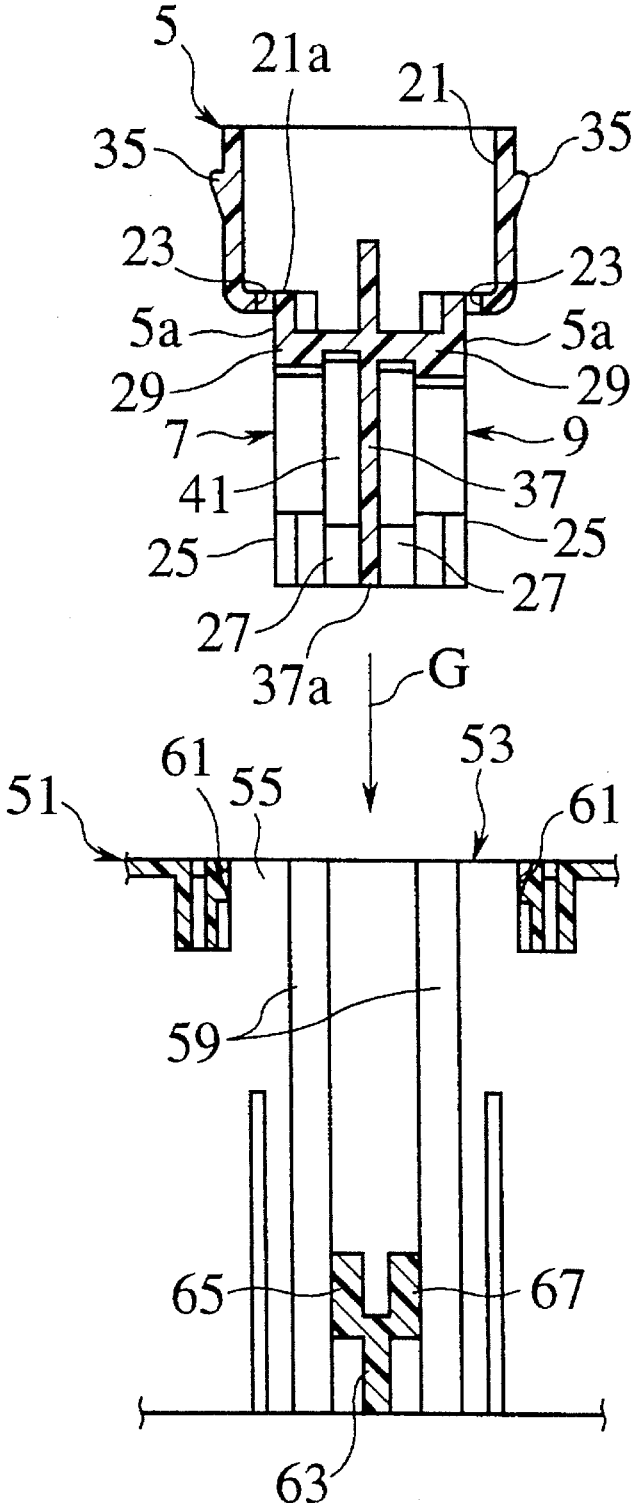
FIG. 2 is a cross sectional view of the connecting structure, taken along a line of A—A of FIG. 1.
Figure 3:
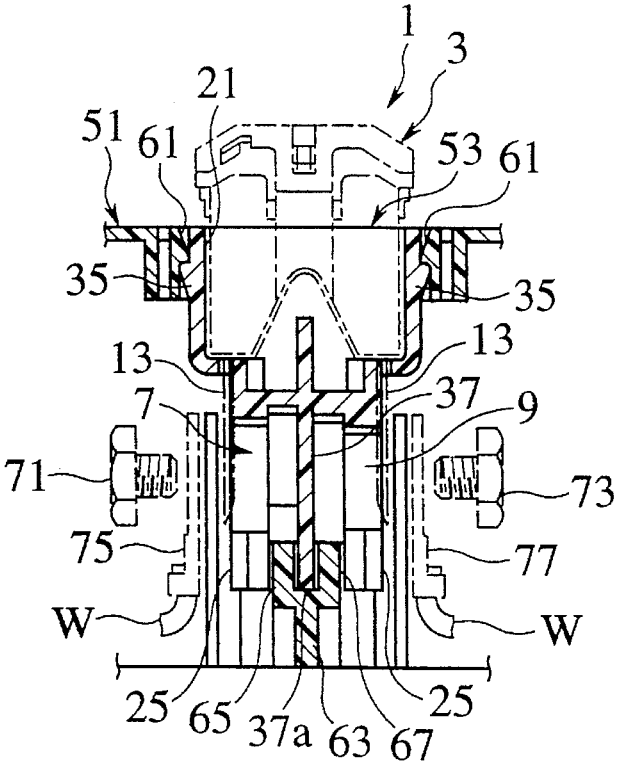
FIG. 3 is a cross sectional view of an inserted fusible link connector.
Figure 4:
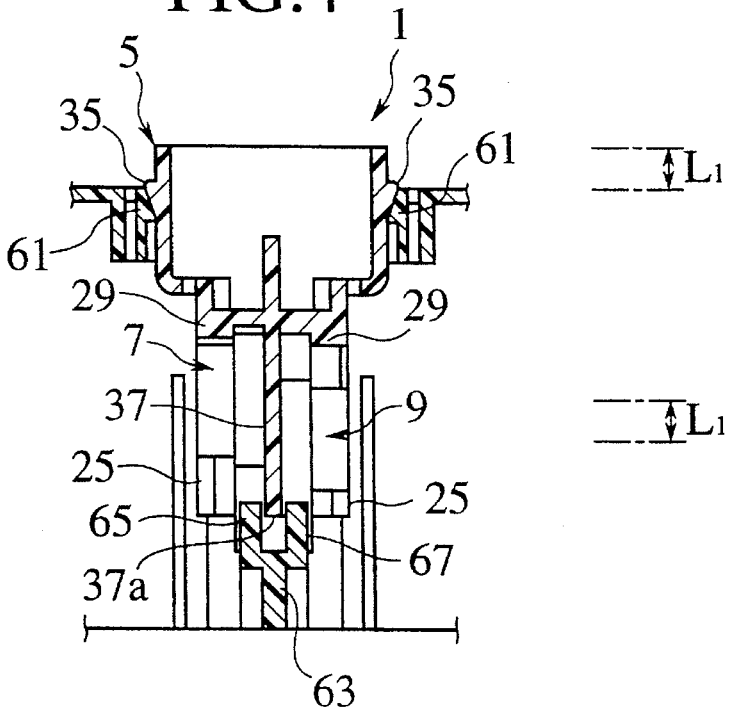
FIG. 4 is a cross sectional view of the fusible link connector, in which a nut is fitted incompletely.

In the figure, FIG. 1 is a perspective view showing a connecting structure for a screw-down type connector in accordance with an embodiment of the present invention, FIG. 2 a cross sectional view of the connecting structure, FIG. 3 a cross sectional view of an inserted fusible link connector and FIG. 4 is a cross sectional view of the fusible link connector, in which a nut is fitted incompletely.

A fusible link connector 1 as a screw-down connector consists of a fusible link 3, an insulating housing 5 and a pair of nuts 7 and 9. Note, the fusible link connector 1 will be referred as "the FL connector", hereinafter.

The fusible link 3 includes a synthetic resinous casing 11 for covering a not-shown fusing section and a pair of connector terminals 13 projecting from a underside of the casing 11 and having grooves **13*a*** formed for passing a bolt therethorugh, respectively.

The insulating housing 5 is provided on an upper part thereof with a recess 21 which opens upwardly for accommodating the fusible link 3. In the recess 21, the insulating housing 5 has a pair of through holes 23 formed on a bottom **21*a* to correspond to the connector terminals 13, respectively. By moving the fusible link 3 toward the insulating housing 5 along a direction E of FIG. 1 while adjusting the connector terminals 13 to the through holes 23, the casing 11 is supported on the bottom 21*a* of the recess 21, so that the fusible link 3 is accommodated in the insulating housing 5**.

As shown in FIG. 2, the through holes 23 penetrate the bottom **21*a* up and down. Below the through holes 23, the insulating housing 5 is provided on side walls 5*a* thereof with portions 25 into which the nuts 7, 9 are fitted respectively. Note, the portions 25 will be referred to "nut-fitting portion 25", hereinafter. Being arranged on both sides of an intermediate wall 37, each nut-fitting portion 25 includes a pair of fitting grooves 27 opposing to each other and stops 29 projecting between the fitting grooves 27. The fitting grooves 27** are formed so as to extend in upward and downward directions and to open at the underside.

The nuts 7, 9 are provided on respective outer peripheries thereof with flanges 41 which engage in the fitting grooves 27. In case of moving the nuts 7, 9 upwardly from an underside of the insulating housing 5 along a direction F of FIG. 1 while engaging the flanges 41 in the fitting grooves 27, the nuts 7, 9 are guided along inside and outside surfaces of the intermediate wall 37 thereby to abut on the stops 29, respectively. In this way, owing to contact with the stops 29, the nuts 7, 9 can be brought into predetermined limiting positions in the insulating housing 5 and positioned inside of the connector terminal grooves 13*a* projecting from the through holes 23 downwardly. In addition, in order to limit rotation of the inserted nuts 7, 9, the opposing fitting grooves 27 are adapted so that a distance therebetween is smaller than a width of the flange 41. Note, the above-mentioned insertion of the nuts 7, 9 into the fitting grooves 27 are accomplished by using an exclusive jig i.e., so-called press-fitting, normally.

In this way, the FL connector 1 can be assembled by fitting the nuts 7, 9 into the nut-fitting portions 25 while attaching the fusible link 3 to the recess 21 of the insulating housing 5.

As shown in FIG. 1, the insulating housing 5 further has one insert guide 31 and two insert guides 33 formed on opposite side walls 5*b* where the nut-fitting portions 25 are not provided, respectively, along the upward and downward directions. The reason why a number of the insert guide 33 is not equal to that of the insert guide 31 is that it is directed to prevent the FL connector 1 from being attached to an electrical connection box 51 conversely by mistake. In addition, the insulating housing 5 is provided above the nut-fitting portions 25 with engagement projections 35 which project from outer walls of the housing 5, respectively.

The electrical connection box 51 is provided with a portion 53 for receiving the FL connector 1 therein. Note, the portion 53 will be referred as "the connector receiving portion 53", hereinafter. The connector receiving portion 53 consists of an inlet 55 shaped so as to accord with a profile of the insulating housing 5, an inside wall 55*a* extending from the inlet 55 downwardly, a plurality of guide grooves 57, 59 formed in the inside wall 55*a* up and down, a pair of flexible engagement pawls 61 projecting inwardly in the inlet 55, an opening 69 which opens below the inserted FL connector 1, and a projection 63 formed so as to project from the inside wall 55*a* for supporting the insulating housing 5 of the inserted FL connector 1 from the underside. Note, the projection 63 will be referred as "the housing-abutting part 63", hereinafter.

With the arrangement mentioned above, according to the embodiment, the connector receiving portion 53 further includes a pair of bar-shaped projections 65, 67 formed so as to project upwardly adjacent to the housing-abutting part 63. These projections 65, 67 are provided to abut on the nuts 7, 9 in the inserted FL connector 1, respectively, thereby to urge them upwardly. Note, being derived from their functions, these projections 65, 67 will be referred to "the nut-abutting parts 65, 67", hereinafter.

The nut-abutting parts 65, 67, which are positioned on both sides of the intermediate wall 37 of the insulating housing 5 inserted into the regular position, are formed to project in substantial U-shaped manner thereby to provide a Y-shaped cross section together with the housing-abutting part 63.

In assembly, the guides 31, 33 of the insulating housing 5 are inserted into the guide grooves 57, 59 so as to slide therein while the engagement pawls 61 are engaged with the engagement projections 35. Then, under condition of abutting on the nuts 7, 9 fitted to the utmost position in the insulating housing 5, the nut-abutting parts 65, 67 serve to restrict a limit of the inserted insulating housing 5 to the regular position. Simultaneously, the housing-abutting part 63 abuts on the intermediate wall 37, while the nut-abutting parts 65, 67 serve to support the wall 37 on the side of a lower end 37*a* thereof laterally.

On the other hand, in case that the nuts 7, 9 are fitted into the insulating housing 5 incompletely, the nut-abutting parts 65, 67 serve to prevent the insulating housing 5 from inserting into the regular position, abutting on such nuts 7, 9. In the embodiment, since the nuts 7, 9 are fitted into the nut-fitting portions 25 under pressure, the insulating housing 5 is not further inserted on condition that the nuts 7, 9 in incomplete fitting condition come into contact with the nut-abutting parts 65, 67.

Similarly to the conventional FL connector, the FL connector 1 of the embodiment is assembled by inserting the fusible link 3 into the recess 21 upon fitting the nuts 7, 9 into the nut-fitting portions 25 of the insulating housing 5. Then, in order to fit the FL connector 1 assembled in this way in the connector receiving portion 53 of the electrical connection box 51, the lower end of the insulating housing 5 is inserted into the inlet 55 while aligning the guides 31, 33 of the housing 5 with the guide grooves 57, 59, respectively. With the above insertion of the housing 5, it can be shifted along the guide grooves 57, 59 downwardly, as shown with arrows G of FIGS. 1 and 2.

Hereat, in case that the nuts 7, 9 are engaged into the predetermined utmost position in the insulating housing 5, not only the lower end 37*a* of the intermediate wall 37 does abut on the housing-abutting part 63 but also the nuts 7, 9 come into contact with the nut-abutting parts 65, 67, respectively, as shown in FIG. 3. Consequently, a limit in position of the inserted insulating housing 5 can be defined to the regular position, while the engagement projections 35 are engaged with the engagement pawls 61, so that the FL connector 1 can be attached to the electrical connection box 51. As to the FL connector 1 attached in this way, a pair of plate terminals 75, 77 are electrically connected to the fuse terminals 13 thereof by tightening connection bolts 71, 73.

On the contrary, in case that the nut 9 is fitted into the insulating housing 5 incompletely as shown in FIG. 4, the nut 9 comes into contact with the nut-abutting part 67 before the insulating housing 5 is moved up to the regular position, so that the housing 5 cannot be inserted any more. According to the embodiment, a relationship in position between the insulating housing 5 and the electrical connection box 51 is so established that the upper end of the insulating housing 5 under its complete attached condition is substantially level with an surface of the electrical connection box 51. Thus, for example, if the insertion of the nut 9 is quitted at a position remaining a distance L1 for the utmost position, the insertion of the insulating housing 5 will be quitted on condition that the upper end of the housing 5 protrudes from the surface of the electrical connection box 51 by the distance L1 approximately. Therefore, it is possible for an operator to detect the presence of the nut 9 fitted incompletely at the opportunity for inserting the FL connector 1, which is before the plate terminal 77 is connected, thereby to improve the workability in tightening the connection bolt 73 (see FIG. 3).

Further, since the nut-abutting parts 65, 67 are arranged to project from the housing-abutting part 63 on both sides of the intermediate wall 37 along the inserting directions of the nuts 7, 9, there is no possibility that the opening 69 is closed by the housing-abutting part 63 and the nut-abutting part 65, so that radiation of heat from the FL connector 1 can be realized through the opening 69 efficiently thereby to improve the durability of the FL connector 1.

Since the lower end 37*a* of the insulating housing 5 is supported by the housing-abutting part 63 directly while the intermediate wall 37 is partially supported on the side of lower end 37*a* thereof by the nut-abutting parts 65, 67 laterally, the FL connector 1 can be attached to the box 51 more stably.

In addition, in either case of increasing the rigidity of the nut-abutting parts 65, 67 or decreasing insertion force of the nuts 7, 9 into the nut-fitting portions 25, the nut-abutting parts 65, 67 allow the nuts 7, 9, which have been fitted incompletely, to be shifted up to the utmost position by an insertion of the FL connector 1 into the regular position. That is, Therefore, in case that the nut 9 is fitted into the insulating housing 5 incompletely as shown in FIG. 4, it is possible to fit the nut 9 into the utmost position securely by an operation to insert the insulating housing 5 into the regular position.

Furthermore, with the above increase in rigidity of the nut-abutting parts 65, 67, it is possible to prevent the nuts 7, 9 from rotating together in tightening the terminal connection bolts 71, 73 (see FIG. 3). In such a case, the fitting force for the nuts 7, 9 would be reduced thereby to improve the workability in fitting the same.

Finally, it will be understood by those skilled in the art that the foregoing description is one of preferred embodiments of the disclosed connecting structure, and that various changes and modifications may be made to the present invention without departing from the spirit and scope thereof.

What is claimed is:

1. A connecting structure comprising:

at least one nut which is formed so as to engage with a terminal connection bolt;

a screw-down type connector including an insulating housing into which said nut is to be inserted and fitted in a predetermined utmost position; and an electrical connection box having a concave connector receiving portion into which said screw-down type connector is to be inserted and fitted in a direction opposite to another direction along which said nut is inserted into said insulating housing, said connector receiving portion being provided with a nut-abutting part for urging said nut;

wherein, when said nut-abutting part comes into contact with said nut in the utmost position, said nut-abutting part serves to define a positional limit of said insulating housing inserted into said connector receiving portion to a predetermined regular position;

wherein, when said nut-abutting part comes into contact with said nut which is not inserted up to the utmost position completely, said nut-abutting part serves to prevent said insulating housing from being inserted into said predetermined regular position.

2. A connecting structure as claimed in claim 1, wherein said nut-abutting part is adapted in such a manner that, when said nut is inserted into the insulating housing incompletely, said nut-abutting part allows said nut to move up to the utmost position with the insertion of said screw-down type connector for said predetermined regular position.

3. A connecting structure as claimed in claim 1 or 2, wherein said nut is provided with a flange while said insulating housing is provided with a fitting groove into which said flange is to be inserted and wherein, when said nut-abutting part comes into contact with said flange, said nut-abutting part serves to prevent said nut from being rotated in tightening said terminal connection bolt to said screw-down type connector.

4. A connecting structure comprising:

a pair of nuts which are formed so as to engage with terminal connection bolts;

a screw-down type connector including an insulating housing into which said nuts are to be inserted and fitted in a predetermined utmost positions; and an electrical connection box having a concave connector receiving portion into which said screw-down type connector is to be inserted and fitted in a direction opposite to another direction along which said nuts are inserted into said insulating housing, said connector receiving portion being provided with a pair of nut-abutting parts for urging said nuts, respectively;

wherein, when said nut-abutting parts come into contact with said nuts in the respective utmost positions, said nut-abutting parts serve to define a positional limit of said insulating housing inserted into said connector receiving portion to a predetermined regular position;

wherein, when at least either of said nut-abutting parts comes into contact with either of said nuts, which is not inserted up to the utmost position completely, said nut-abutting part serves to prevent said insulating housing from being inserted into said predetermined regular position.

5. A connecting structure as claimed in claim 4, wherein said nut-abutting parts are adapted in such a manner that, when at least either of said nuts is inserted into the insulating housing incompletely, said nut-abutting part allows said nut to move up to the utmost position with the insertion of said screw-down type connector for said predetermined regular position.

6. A connecting structure as claimed in claim 4 or 5, wherein said nuts are provided with flanges while said insulating housing is provided with fitting grooves into which said flanges are to be inserted and wherein, when said nut-abutting parts come into contact with said flanges, said nut-abutting parts serve to prevent said nuts from being rotated in tightening said terminal connection bolts to said screw-down type connector.

7. A connecting structure as claimed in claim 6, wherein said insulating housing is provided with an intermediate wall having inside and outside surfaces along which said nuts are inserted into said insulating housing, respectively.

8. A connecting structure as claimed in claim 7, wherein said connector receiving portion comprises an opening which opens below said screw-down type connector inserted and a housing-abutting part arranged along a lower end of said intermediate wall of said insulating housing inserted up to said predetermined regular position thereby to abut on said intermediate wall.

9. A connecting structure as claimed in claim 8, wherein said nut-abutting parts are formed to project from said housing-abutting part on both sides of said intermediate wall along the inserting direction of said nuts thereby forming a substantial Y-shaped cross section together with said housing-abutting part, so that said intermediate wall of said insulating housing can be supported laterally by said nut-abutting parts.

* * * * *